US005544509A

United States Patent [19]

Mielonen

[11] Patent Number: 5,544,509

[45] Date of Patent: Aug. 13, 1996

[54] CYLINDER LOCK-KEY-COMBINATION

[75] Inventor: Pekka Mielonen, Reijola, Finland

[73] Assignee: Abloy Security Ltd. Oy, Helsinki, Finland

[21] Appl. No.: 329,237

[22] Filed: Oct. 26, 1994

[30] Foreign Application Priority Data

Nov. 19, 1993 [FI] Finland ..... 935157

[51] Int. Cl.[6] ..... E05B 29/02

[52] U.S. Cl. ..... 70/366; 70/496; 70/386

[58] Field of Search ..... 70/365, 366, 386, 70/495, 496

[56] References Cited

U.S. PATENT DOCUMENTS

| | | | |
|---|---|---|---|
| 3,621,689 | 11/1971 | Koskinen et al. | 70/366 |
| 3,848,442 | 11/1974 | Martanen | 70/366 |
| 4,446,709 | 5/1984 | Steinbach | 70/496 |

FOREIGN PATENT DOCUMENTS

| | | | |
|---|---|---|---|
| 1555343 | 3/1968 | France . | |
| 3026480 | 2/1982 | Germany . | |
| 3526173 | 1/1987 | Germany | 70/366 |

*Primary Examiner*—Steven N. Meyers
*Assistant Examiner*—Tuyet-Phuong Pham
*Attorney, Agent, or Firm*—Smith-Hill and Bedell

[57] ABSTRACT

A cylinder lock-key-combination, which comprises a lock body (5) having a lock cylinder (6) which is arranged to control a bolt element (4) connected thereto and which encloses a set of locking discs (7) provided with peripheral notches (13) and being symmetrical so that the cutting range of the peripheral notches (13) determining the opening combination of the lock is located on both sides of their axis of symmetry (A). A locking bar (9;10) which in its locked position is located partly in a groove (12) made in the inner surface of the lock body (5) and partly in a slot (17) in the lock cylinder (6) prevents turning of the lock cylinder (6) with regard to the lock body (5). The locking discs (7) can be turned by means of a key of the lock into a position in which the peripheral notches (13) thereof are located at the position of the locking bar (9;10) forming a uniform channel into which the locking bar (9;10) enters thereby releasing the lock cylinder (6) to turn with regard to the lock body (5). According to the invention the locking bar (9;10)is divided in the longitudinal direction of the lock into two separate locking bar elements (9;10) which together with the locking discs (7) cooperating therewith are arranged to form two locking units functionally independent of each other and the opening direction of which being opposite with regard to each other. Said groove (12) located in the lock body (5) for the locking bar comprises a transversal extension (**12*a*;12*b*) for each of the locking bar elements (9;10) so that the extension (12*a*;12*b*) extends in the opposite direction with regard to the opening direction of the locking unit located at the position thereof thereby allowing movement of the locking bar element (9;10**) in question into said opposite direction without opening the locking unit. Hence, the cylinder lock can be operated in opposite turning directions by means of two separate keys having quite independent combination cuts.

8 Claims, 4 Drawing Sheets

Figure 1:
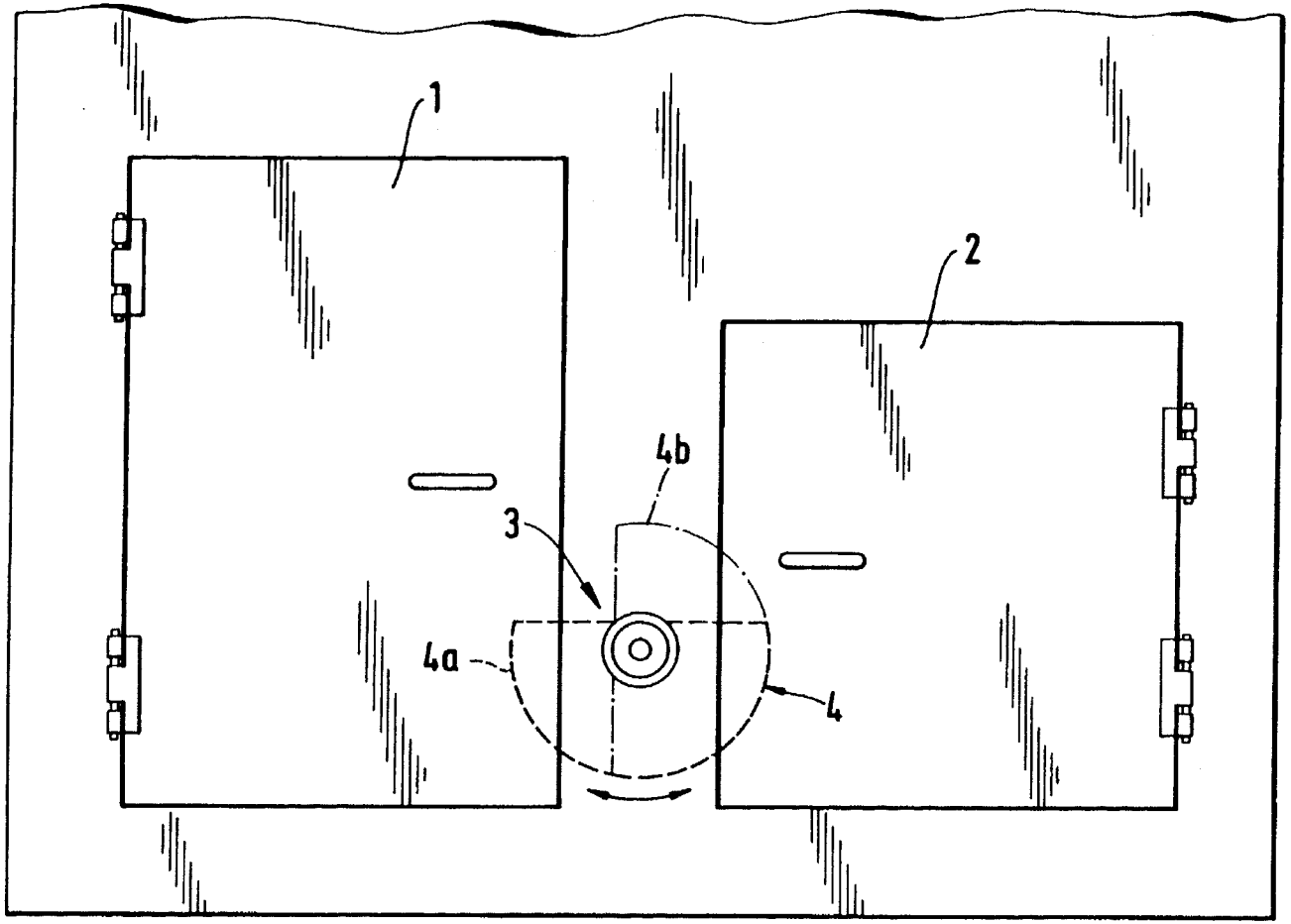

Fig. 3
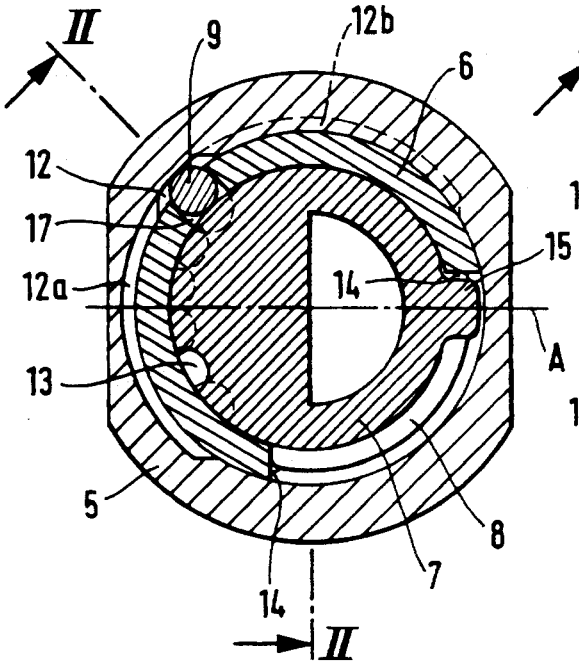
Fig. 4
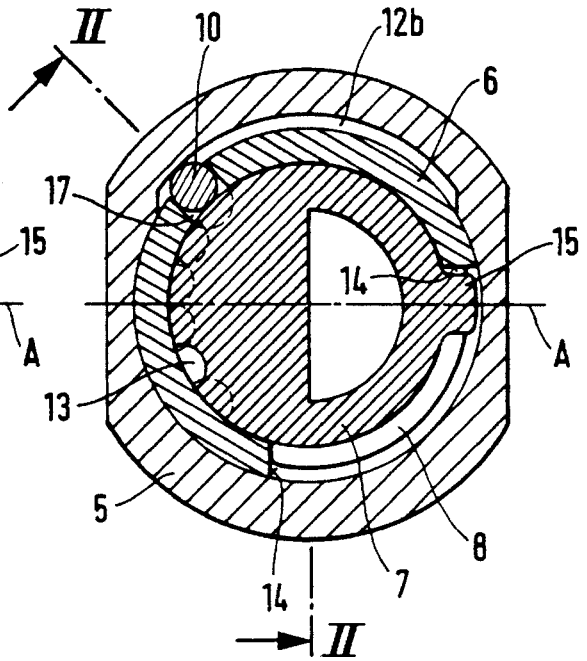
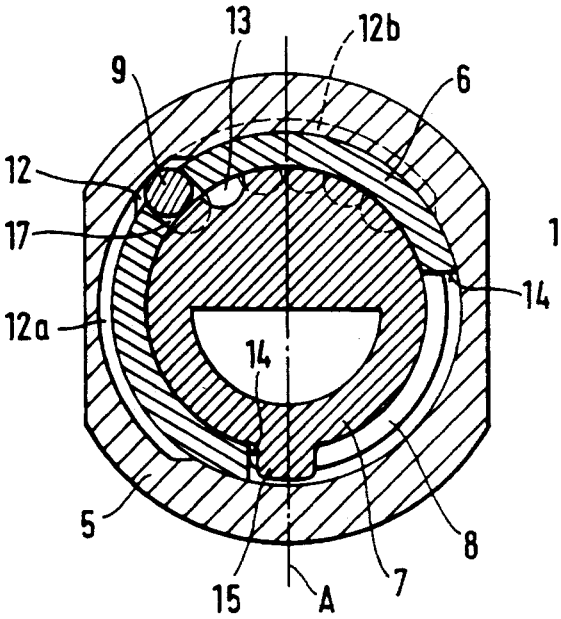
Fig. 5
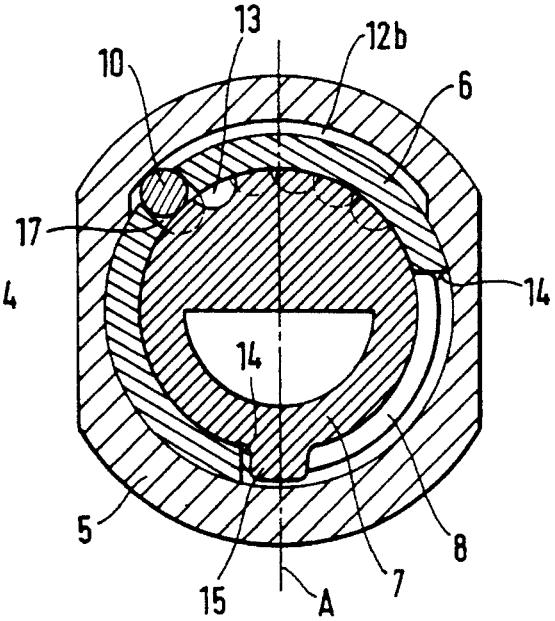
Fig. 6

CYLINDER LOCK-KEY-COMBINATION

The invention relates to a cylinder lock-key-combination.

The patent publication GB 1265023 shows a cylinder lock of the mentioned kind which can be operated in the opposite turning directions by means of two separate keys. This kind of known lock can be employed to lock for example two adjacent safety-deposit boxes, casings or the like so that each of the keys is meant to open only one of the boxes or casings in question.

In this known solution the combination cuts of the keys are on the opposite sides of the axis of symmetry of the keys respectively. In addition the cuts of the keys are mirror-like so that the so-called 0-cut in one key corresponds to the so-called 5-cut in the other key, 1-cut corresponds to 4-cut, 3-cut corresponds to 2-cut, 2-cut corresponds to 3-cut etc. Thus when the combination of one of the keys is known, the correct combination for a key operating in the other direction can easily be accomplished as well, which constitutes a security risk depending on the application.

On the other hand, both the keys act on the same set of locking discs. When the locking mechanism is first opened with one of the keys, the dead bolt attached to the lock cylinder can be turned through the already opened space. In this way it is possible to turn the lock cylinder in the turning direction according to also the other key all the way into the opening position of the dead bolt, because in this case the locking mechanism does not resume its locked position when the turning direction is changed. Thus the locking safety of this known solution is defective.

An aim of the invention is to provide an improved cylinder lock operable in two turning directions by means of two separate keys and from which the above referred defects have been eliminated.

The aim of the invention can be met by means of an arrangement in accordance with which the locking bar is divided in the longitudinal direction of the lock into two separate locking bar elements which together with the locking discs cooperating therewith are arranged to form two locking units functionally independent of each other and the opening direction of which being opposite with regard to each other. In addition said groove located in the lock body for the locking bar comprises a transversal extension for each of the locking bar elements so that the extension extends in the opposite direction with regard to the opening direction of the locking unit located at the position thereof thereby allowing movement of the locking bar element in question into said opposite direction without opening the locking unit. In this way it is possible to operate the lock in different turning directions by means of two keys so that the combination cuts of the keys are quite independent from each other. It is not possible to manipulate the dead bolt and the lock cylinder in the way as described above either, because when one of the locking units is opened the other locking unit respectively remains always in its locked position.

From the viewpoint of the operational ability of the arrangement it is of advantage to arrange between said two locking units a separating disk which is immovable with regard to the lock cylinder and is equipped with a projection separating the locking bar elements from each other.

The axial length of said locking bar elements, and of the locking units corresponding thereto, respectively, can with advantage be different from each other. As the number of the locking discs in a locking unit affects the locking safety, in this way it is possible better to take account of the possibly different safety requirements for the spaces to be locked.

In practice said extensions of the groove in the lock body extend in the direction of the turning movement of the lock cylinder a distance which corresponds to the opening movement of said bolt element connected to the lock cylinder. This movement is of advantage about 90°.

A key for a combination according to the invention comprises combination cuts for a locking unit corresponding only to one of the locking bar elements, whereby the location of the combination cuts with regard to the axis of symmetry of the key is chosen according to the opening direction of the locking unit in each case.

Figures 2, 2A:
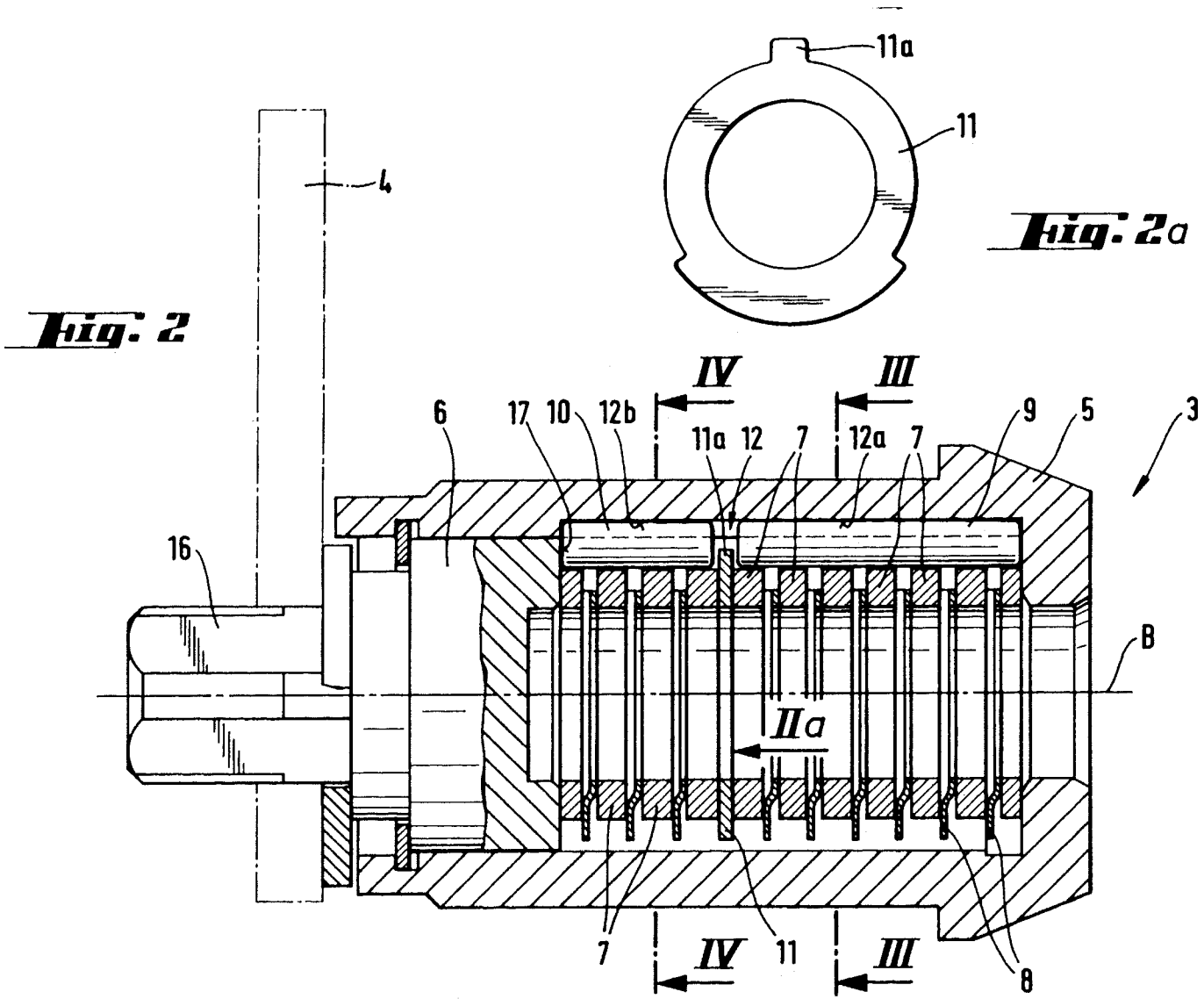
Figure 7:
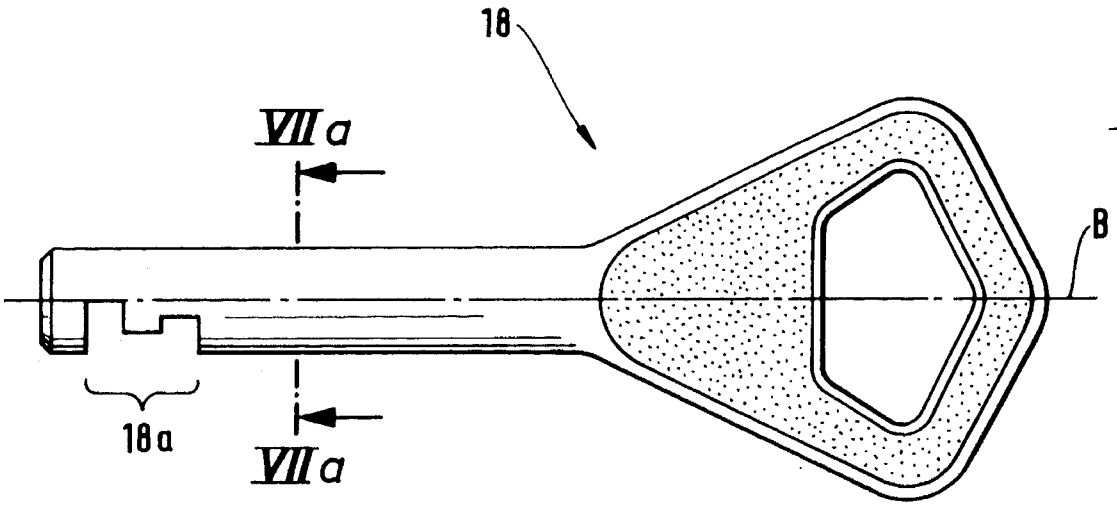
Figure 7A:
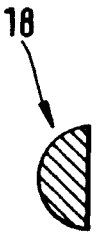
Figure 8:
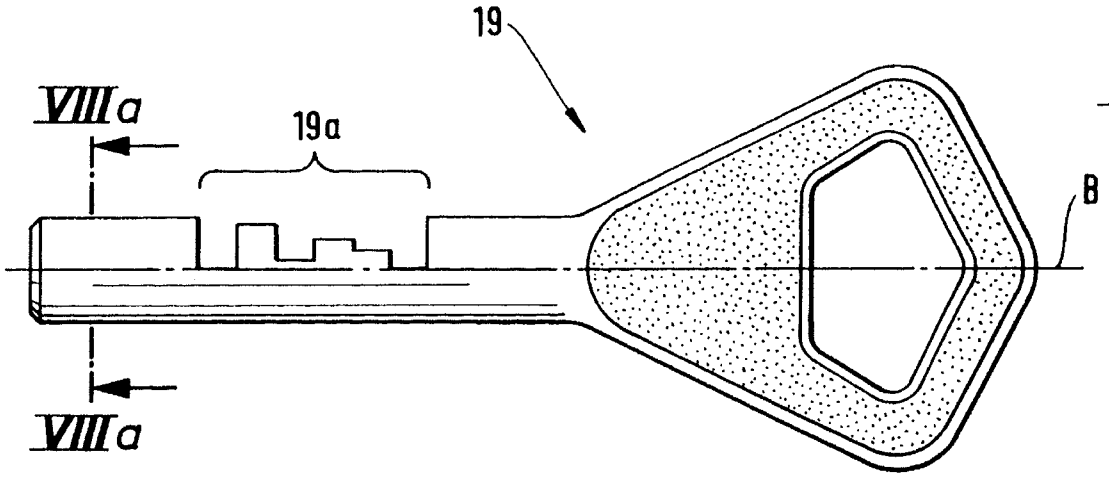
Figure 8A:
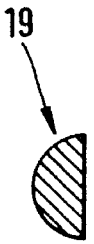

The invention will now be further described, by way of example, with reference to the accompanying drawings, in which FIG. 1 shows an object for applying a cylinder lock-key-combination in accordance with the invention, FIG. 2 shows a cylinder lock in accordance with the invention as a longitudinal section, FIG. 2*a* shows a detail of FIG. 2 in the direction of the arrow IIa, FIG. 3 shows section III—III of FIG. 2 in a situation in which the lock is ready for operation in the clockwise direction, FIG. 4 shows section IV-IV of FIG. 2 in a situation in which the lock is ready for operation in the clockwise direction, FIG. 5 shows section III—III of FIG. 2 in a situation in which the lock is ready for operation in the counter-clockwise direction, FIG. 6 shows section IV-IV of FIG. 2 in a situation in which the lock is ready for operation in the counter-clockwise direction, FIG. 7 shows a key for the inner locking unit of the cylinder lock of FIG. 1 opening the lock in the counter-clockwise direction, FIG. 7*a* is a sectional view taken on the line VII*a*—VII*a* of FIG. 7, FIG. 8 shows a key for the outer locking unit of the cylinder lock of FIG. 1 opening the lock in the clockwise direction, and FIG. 8*a* is a sectional view taken on the line VIII*a*—VIII*a* of FIG. 8.

In the drawings 1 and 2 indicate openable covers or wings for two adjacent safety-deposit boxes, casings or the like, the locking of which takes place by means of only one cylinder lock 3 and a bolt element 4 attached thereto and which in its basic position (designated 4*a* in FIG. 1 ) locks both covers or wings. The bolt element 4 can be turned by two separate keys in the opposite turning directions in about 90° into a position in which one of the covers or wings 1 or 2 can be opened with the other, respectively, remaining locked. The position in which the wing 1 can be opened while the wing 2 remains locked is designated 4*b* in FIG. 1.

The cylinder lock 3 comprises a lock body 5, and inside it, a turnable lock cylinder 6, which encloses a set of locking discs 7 provided with peripheral notches 13 and separated from each other by means of intermediate discs 8. The locking discs 7 are symmetrical so that the cutting range for the peripheral notches 13 determining the opening combination of the lock is located on both sides of the axis of symmetry A of the discs. In FIGS. 3–6 the possible positions for the peripheral notches 13 are shown in dotted lines.

The locking bar of the lock is divided in the longitudinal direction of the lock into two separate locking bar elements 9 and 10, which together with the locking discs 7 cooperating therewith are arranged to form two locking units which are functionally independent of each other and the opening direction of which is opposite with regard to each other. The locking bars 9 and 10 are located in their locked position partly in a groove 12 made in the inner surface of the lock body 5 and partly in a slot 17 in the lock cylinder 6 preventing turning of the lock cylinder 6 with regard to the lock body 5. The set of locking discs is turnable by means of a key of the lock into a position, in which the peripheral notches 13 of the locking discs 7 of one or the other of the locking units move at the position of the locking bar 9 or 10 corresponding to it to form a uniform channel into which the locking bar in question enters thereby releasing the locking cylinder 6 to turn with regard to the lock body 5. At the same time the turning movement is transferred to the bolt element 4 via a force transmission member 16 attached to the lock cylinder 6.

So in this case only one of the locking units with its locking bar opens at a time. In order that said opening movement of the bolt element 4 of about 90° can be made independent of the other locking unit respectively, the said groove 12 for the locking bar in the lock body 5 comprises an extension 12*a* or 12*b* transversal with regard to the locking bar for each of the locking bar elements 9 or 10 so that the extension 12*a* or 12*b* extends in the opposite direction with regard to the opening direction of the locking unit located at the position thereof, whereby it allows movement of the locking bar element 9 or 10 in question into said opposite direction without opening the locking unit.

The lock cylinder 6 is also provided with a separating disk 11 which is immovable with regard to it and is equipped with a protrusion 11*a* arranged between the locking bars 9 and 10 in order to separate them from each other (cf FIG. 2). The locking discs 7 for their part are equipped with protrusions 15 which together with two stop surfaces 14 in the lock cylinder 6 restrict the turning range of the locking discs 7 with regard to the lock cylinder 6 to a turning angle of about 90°.

In order to open said locking units the set of discs must first be turned by means of a key of the lock into one or the other end position defined by the turning range of the locking discs, depending on the opening direction. In the case of FIGS. 3 and 4 the locking unit corresponding to the locking bar element 9 can be opened by turning the locking discs 7 in the clockwise direction. FIG. 8 shows a key 19 suitable for this purpose and including combination cuts 19*a*. After opening of this locking unit the bolt element 4 can be moved by turning the key 19 further in the same direction. At the same time the locking bar element 10 respectively moves along the groove extension 12*b* thereby enabling this turning movement (of FIG. 4). Similarly, FIGS. 5 and 6 show the initial position for the opening of the locking unit corresponding to the locking bar element 10. The opening takes place now in the counter-clockwise direction by turning a key 18 that is shown in FIG. 7. In this case the combination cuts 18*a* in the key arrange the peripheral notches 13 of the locking discs 7 corresponding thereto under the locking bar element 10, whereby the locking unit in question is released. Similarly, the groove extension 12*a* allows the locking bar element 9 and the locking discs 7 corresponding thereto to be turned a turning angle required by the opening of the bolt element 4.

As obvious from FIGS. 3 and 4 when compared with FIGS. 5 and 6, when the keys 18 and 19 are used in successive order so as to operate the two locking units of the cylinder lock 3 in turn, the set of discs must first be turned 90° in the opposite direction so as to rearrange the locking discs 7 before operating the lock in the desired turning direction.

In order to know how to draw the key in the correct position out from the lock after locking is accomplished the lock can be provided with an identification for the correct position. Solutions known as such can be applied for the purpose. For example the inner end of the lock cylinder can be provided with a spring-loaded ball which together with the groove extension 12 in the lock body indicates the removal position for the key.

As obvious from FIGS. 7 and 8 the combination cuts 18*a* and 19*a* in the keys 18 and 19 operable in different turning directions respectively are made on different sides of the axis of symmetry B of the key.

The invention is not restricted to the embodiment shown but several modifications are feasible within the scope of the attached claims.

I claim:

1. A cylinder lock apparatus, which comprises a lock body (5) having a lock cylinder (6) which is arranged to control a bolt element (4) connected thereto and which encloses a stack of locking discs (7) provided with peripheral notches (13) determining an opening combination of the lock, the peripheral notches being located within a cutting range, and the locking discs being symmetrical so that the cutting range of the peripheral notches (13) is located on both sides of their axis of symmetry (A), and first and second locking bar elements (9;10) which in a locked position are located partly in a longitudinal groove (12) made in an inner surface of the lock body (5) and partly in a slot (17) in the lock cylinder (6) preventing turning of the lock cylinder (6) with regard to the lock body (5), whereby a first set of the locking discs (7) can be turned by means of a first key of the lock in a first direction into a position in which the peripheral notches (13) thereof form a uniform channel into which the first locking bar element (9) enters thereby releasing the lock cylinder (6) to turn with regard to the lock body (5) in said first direction, and a second set of the locking discs can be turned by means of a second key of the lock in a second direction, opposite the first direction, into a position in which the peripheral notches (13) thereof form a uniform channel into which the second locking bar element (10) enters thereby releasing the lock cylinder (6) to turn with regard to the lock body (5) in said second direction, whereby the first locking bar element and the first set of locking discs form a first locking unit and the second locking bar element and the second set of locking discs form a second locking unit, the two locking units being functionally independent of each other the opening direction of which being opposite with regard to each, and the groove (12) located in the lock body (5) comprising a transversal extension (12*a*;12*b*) for each of the locking bar elements (9;10) so that the extension (12*a*) for the first locking bar element (9) extends in the second direction and the extension (12*b*) for the second locking bar element (10) extends in the first direction thereby allowing movement of the locking bar element (9;10) in question without the respective locking unit being open.

2. A cylinder lock apparatus according to claim 1, wherein a separating disk (11), which is immovable with regard to the lock cylinder (6), is arranged between said two locking units and is equipped with a projection (11*a*) separating the locking bar elements (9;10) from each other.

3. A cylinder lock apparatus according to claim 1, wherein axial length of said locking bar elements (9;10), and of the locking units corresponding thereto, respectively, is different from each other.

4. A cylinder lock apparatus according to claim 1, wherein the extension (12*a*) for the first locking bar (9) extends in said second direction a distance which corresponds to opening movement of said bolt element (4) connected to the lock cylinder (6) and the extension (12*b*) for the second locking bar (10) extends in said first direction a distance which corresponds to the opening movement of said bolt (4).

5. A cylinder lock apparatus according to claim 1, further comprising at least one key having combination cuts (18*a*;19*a*) for only one of the two functionally independent locking units corresponding to only one of the locking bar elements (9;10), the location of the combination cuts (18*a*;19*a*) with regard to the axis of symmetry (B) of the key being chosen according to the opening direction of the said one locking unit.

6. A cylinder lock apparatus to claim 1, including first and second keys, wherein each key comprises an elongate shank having first and second opposite ends and a bow at the first end of the shank, the shank having first and second mutually exclusive length segments between the bow and the second end of the shank, with the first length segment between the second length segment and the bow, each shank having a set of combination cuts formed therein, wherein the set of combination cuts in the shank of the first key are exclusively in the first length segment and the second length segment of the shank of the first key is non-circular and has an axis of symmetry, and the set of combination cuts in the shank of the second key are exclusively in the second length segment and the first length segment of the shank of the second key is non-circular and has an axis of symmetry, and the two sets of combination cuts are at opposite sides respectively of the axes of symmetry of the respective shanks.

7. A cylinder lock apparatus according to claim 1, further comprising a pair of first and second keys, each key comprising an elongate shank having first and second opposite ends and a bow at the first end of the shank, the shank having first and second mutually exclusive length segments between the bow and the second end of the shank, with the first length segment between the second length segment and the bow, each shank having a set of combination cuts formed therein, wherein the set of combination cuts in the shank of the first key are exclusively in the first length segment and the second length segment of the shank of the first key is non-circular and has an axis of symmetry, and the set of combination cuts in the shank of the second key are exclusively in the second length segment and the first length segment of the shank of the second key is non-circular and has an axis of symmetry, and the two sets of combination cuts are at opposite sides respectively of the axes of symmetry of the respective shanks.

8. A locking system for first and second adjacent containers having respective openable covers, said locking system comprising:

a cylinder lock which comprises a lock body (5) having a lock cylinder (6) which encloses a stack of locking discs (7) provided with peripheral notches (13) determining an opening combination of the lock, the peripheral notches being located within a cutting range, and the locking discs being symmetrical so that the cutting range of the peripheral notches (13) is located on both sides of their axis of symmetry (A), and first and second locking bar elements (9;10) which in a locked position are located partly in a longitudinal groove (12) made in an inner surface of the lock body (5) and partly in a slot (17) in the lock cylinder (6) preventing turning of the lock cylinder (6) with regard to the lock body (5), whereby a first set of the locking discs (7) can be turned by means of a key of the lock in a first direction into a position in which the peripheral notches (13) thereof form a uniform channel into which the first locking bar element (9) enters thereby releasing the lock cylinder (6) to turn with regard to the lock body (5) in said first direction, and a second set of the locking discs can be turned by means of a key of the lock in a second direction, opposite the first direction, into a position in which the peripheral notches (13) thereof form a uniform channel into which the second locking bar element (10) enters thereby releasing the lock cylinder (6) to turn, with regard to the lock body (5) in said second direction, whereby the first locking bar element and the first set of locking discs form a first locking unit and the second locking bar element and the second set of locking discs form a second locking unit, the two locking units being functionally independent of each other, and the groove (12) located in the lock body (5) comprising a transversal extension (12*a*;12*b*) for each of the locking bar elements (9;10) so that the extension (12*a*) for the first locking bar element (9) extends in the second direction and the extension (12*b*) for the second locking bar element (10) extends in the first direction thereby allowing movement of the locking bar element (9;10) in question without the respective locking unit being open, at least first and second keys (18;19), for the first and second locking units respectively of the cylinder lock (3), and a bolt element connected to the lock cylinder and controlled thereby, wherein said bolt element (4), in a basic position, being arranged to lock both the containers, whereby either one of the locking units can be opened with its own key and said bolt element (4) be moved into a position, in which one of the containers can be opened, the other locking unit of the cylinder lock, and as a consequence thereof, the other container remaining locked respectively, and wherein the transversal extension for the first locking bar element extends in the second direction a distance which corresponds to the opening movement of said bolt element from its basic position to the position in which the first container can be opened and the transversal extension for the second locking bar element extends in the first direction a distance which corresponds to the opening movement of said bolt element from its basic position to the position in which the second container can be opened.

* * * * *